US007184689B2

(12) United States Patent
Kang et al.

(10) Patent No.: US 7,184,689 B2
(45) Date of Patent: Feb. 27, 2007

(54) DEVELOPING CARTRIDGE HAVING PROTECTIVE COVER AND IMAGE FORMING APPARATUS INCLUDING THE SAME

(75) Inventors: Il-Kwon Kang, Suwon-si (KR); Heung-sup Jeong, Suwon-si (KR); Se-hyun Lyu, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 46 days.

(21) Appl. No.: 11/079,092

(22) Filed: Mar. 15, 2005

(65) Prior Publication Data

US 2005/0238385 A1 Oct. 27, 2005

(30) Foreign Application Priority Data

Apr. 27, 2004 (KR) ..... 10-2004-0029184

(51) Int. Cl.
*G03G 21/18* (2006.01)

(52) U.S. Cl. ..... 399/114

(58) Field of Classification Search ..... 399/110, 399/111, 114, 116, 117
See application file for complete search history.

(56) References Cited

U.S. PATENT DOCUMENTS

| | | | | |
|---|---|---|---|---|
| 4,470,689 | A * | 9/1984 | Nomura et al. | 399/114 |
| 5,113,220 | A | 5/1992 | Kwak | |
| 5,231,453 | A * | 7/1993 | Nakai et al. | 399/114 |
| 5,266,999 | A * | 11/1993 | Yashiro | 399/114 |
| 6,968,142 | B2 * | 11/2005 | Arimitsu et al. | 399/114 |

FOREIGN PATENT DOCUMENTS

| | | |
|---|---|---|
| JP | 57-211181 | 12/1982 |
| JP | 61-014677 | 1/1986 |
| JP | 04-153662 | 5/1992 |
| JP | 06-148965 | 5/1994 |
| JP | 06-186793 | 7/1994 |

* cited by examiner

*Primary Examiner*—Sandra L. Brase
(74) *Attorney, Agent, or Firm*—Roylance, Abrams, Berdo & Goodman, L.L.P.

(57) ABSTRACT

A developing cartridge includes a housing having a photosensitive medium, and a protective cover movable between a first position where the protective cover covers the photosensitive medium and a second position where a part of the photosensitive medium is exposed. A guide unit guides the protective cover to prevent exceeding a range occupied by the housing when the protective cover is moved to the first and second positions.

15 Claims, 9 Drawing Sheets

DEVELOPING CARTRIDGE HAVING PROTECTIVE COVER AND IMAGE FORMING APPARATUS INCLUDING THE SAME

CROSS-REFERENCE TO RELATED APPLICATIONS

This application claims the benefit under 35 U.S.C. § 119(a) of Korean Patent Application No. 10-2004-0029184, filed on Apr. 27, 2004, in the Korean Intellectual Property Office, the entire disclosure of which is hereby incorporated by reference.

BACKGROUND OF THE INVENTION

1. Field of the Invention

The present invention relates to a developing cartridge installed in an electrophotographic image forming apparatus.

2. Description of the Related Art

In general, an electrophotographic image forming apparatus forms an image by scanning light onto a charged photosensitive medium to form an electrostatic latent image corresponding to a desired image. The electrostatic latent image is developed by supplying a toner onto the image. The developed image on the photosensitive medium is transferred through an intermediate transfer medium or directly onto a sheet of paper. The transferred image is fused using heat and pressure.

In the electrophotographic image forming apparatus, the photosensitive drum is generally provided as a cartridge since it is a consumable that should be replaced when its life span is completed. At least a part of the photosensitive drum is exposed to the outside of the cartridge to transfer the toner image developed on an outer circumference thereof onto the intermediate transfer medium or the paper. When the cartridge is separated from the image forming apparatus, light is irradiated onto the exposed portion, thereby degrading characteristics of the photosensitive medium. Therefore, the cartridge includes a protective cover for protecting the exposed portion of the photosensitive medium from natural light.

Japanese Laid-open Patent Publication JP 06-148965 discloses a developing cartridge having a protective cover for protecting a photosensitive drum. The protective cover is discharged out of the image forming apparatus by a paper conveying device when the developing cartridge is installed in the image forming apparatus. Thus, the developing cartridge is removed from the image forming apparatus, the photosensitive drum is exposed to natural light.

Japanese Laid-open Patent Publication JP. 06-186793, JP. 57-211181, and U.S. Pat. No. 5,113,220 disclose protective covers that are rotatably installed on developing cartridges. The protective cover is moved to a position for exposing the photosensitive drum from a position for protecting the photosensitive drum when the developing cartridge is installed in the image forming apparatus. However, the movement path of the protective cover or the position of the protective cover after moving operation exceeds the portion occupied by the developing cartridge. Therefore, other elements of the image forming apparatus cannot be arranged on the moving path of the protective cover and the portion occupied by the protective cover.

SUMMARY OF THE INVENTION

Embodiments of the present invention provide a developing cartridge that occupies minimum operational space and has a protective cover to protect a photosensitive medium from external light, and an image forming apparatus including the developing cartridge.

According to an aspect of the present invention, a developing cartridge includes a housing having a photosensitive medium. A protective cover, preferably made of a flexible sheet, is movable between a first position where the protective cover covers the photosensitive medium and a second position where a part of the photosensitive medium is exposed. A guide unit guides the protective cover so as not to exceed a range occupied by the housing when the protective cover is moved to the first and second positions.

According to another aspect of the present invention, an image forming apparatus includes a main body and a developing cartridge having a housing with a photosensitive medium. A protective cover of flexible sheet form is movable between a first position where the protective cover covers the photosensitive medium and a second position where a part of the photosensitive medium is exposed. A guide unit guides the protective cover so as not to exceed a range occupied by the housing when the protective cover is moved between the first and second positions. A door opens a part of the main body to install and separate the developing cartridge into and from the main body. An opening and closing device is connected to the door to move the protective cover toward the second position when the door is opened, and the first position when the door is closed.

The protective cover may include an opening portion. When the protective cover is located at the second position, a part of the photosensitive medium may be exposed externally through the opening portion.

The guide unit may include a pair of supporting members supporting both end portions of the protective cover in a moving direction of the cover. A rail, in which both end portions of the supporting members are inserted, may be disposed on a side portion of the housing, and form a path for movement of the protective cover.

The guide unit may further include a protective cover guide disposed on a position of the housing, which is apart from the outer circumference of the photosensitive medium, to guide both sides of the protective cover so that the protective cover does not contact the photosensitive medium.

The developing cartridge may further include an elastic member elastically biasing the protective cover to move toward the first position.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numerals will be understood to refer to like parts, components and structures.

DETAILED DESCRIPTION OF EXEMPLARY EMBODIMENTS

Figure 1:
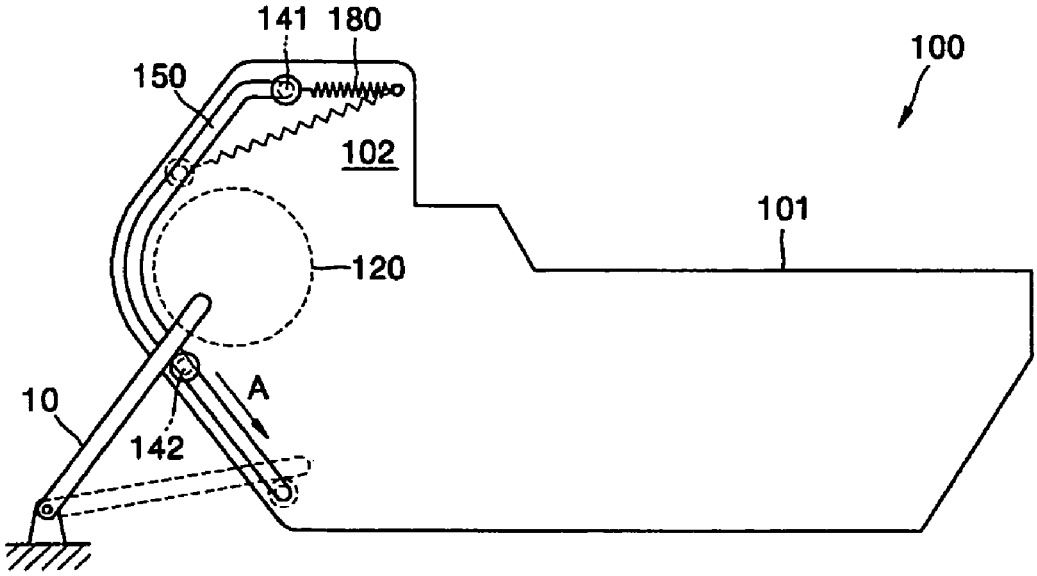
FIG. 1 is a side elevational view of a developing cartridge according to an embodiment of the present invention.
Figure 2:
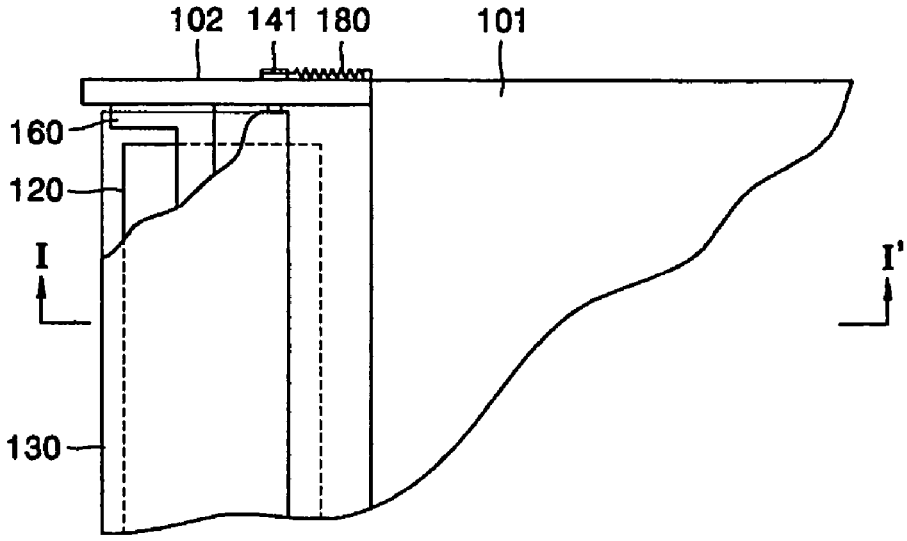
FIG. 2 is a top plan view of the developing cartridge of FIG. 1.
Figure 3:
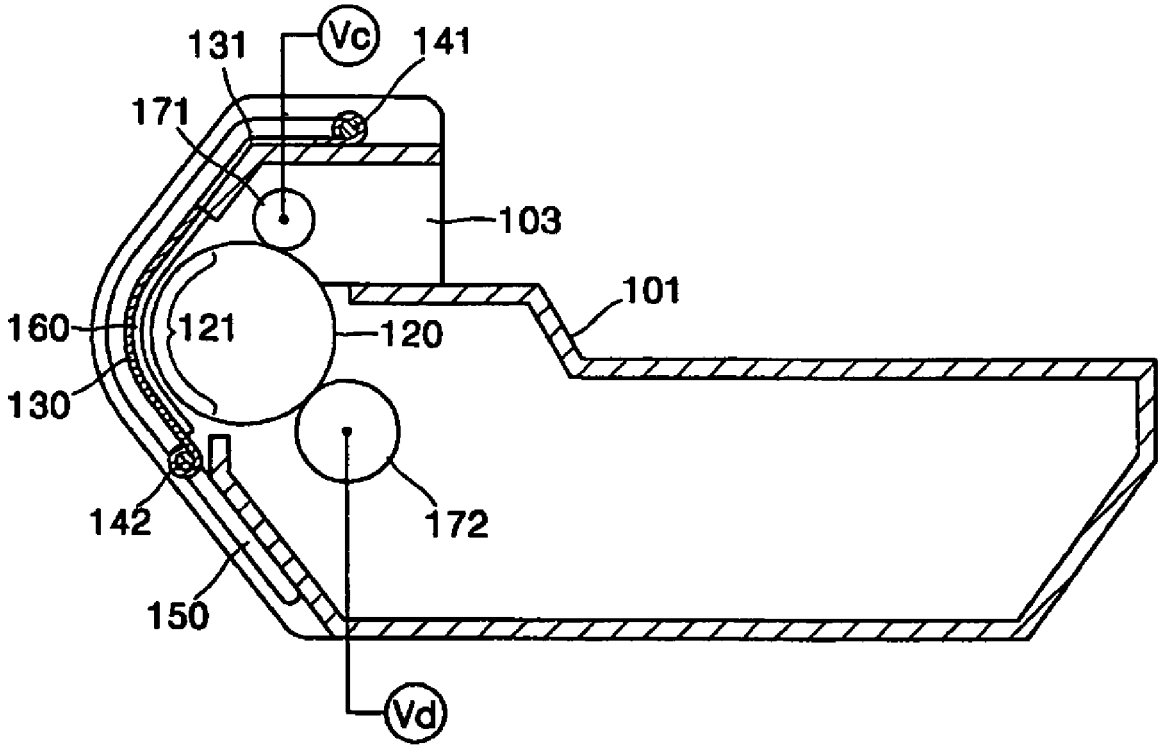
FIG. 3 is a cross-sectional view of the developing cartridge taken along line I–I' of FIG. 2.

FIGS. 1 and 2 are side and plan views of a developing cartridge 100 according to an embodiment of the present invention. FIG. 3 is a cross-sectional view of the developing cartridge taken along line I–I' of FIG. 2.

Referring to FIGS. 1 through 3, a photosensitive drum 120 is rotatably coupled to an end portion of a housing 101. A charging bias Vc is applied to a charging roller 171 to charge an outer circumference of the photosensitive drum 120 to a predetermined potential. A corona discharging device (not shown) may be used instead of the charging roller 171 for charging the photosensitive drum 120. Light corresponding to image information to be printed is scanned from a laser scanning unit (not shown) to the photosensitive drum 120 through an opening 103 disposed on an upper portion of the housing 101. The housing 101 receives a toner therein. A developing roller 172 supplies the toner to the electrostatic latent image by attaching the toner on an outer circumference thereof to form a toner image on an outer circumference of the photosensitive drum 120. A developing bias Vd is applied to the developing roller 172 for attaching the toner onto the electrostatic latent image. The toner image formed on the outer circumference of the photosensitive drum 120 is transferred through an intermediate transfer medium (not shown) or directly onto a sheet of paper (not shown). The photosensitive drum 120 is installed to expose a part 121 of the outer circumference outside of the housing 101 to transfer the toner image onto the intermediated transfer medium or the paper. The developing cartridge 100 may further include a supplying roller (not shown) for attaching the toner onto the developing roller 172, a regulation unit (not shown) for regulating the amount of toner attached on the developing roller 172, and an agitator for moving the toner received in the housing 101 toward the supplying roller and/or the developing roller 172.

Figure 4:
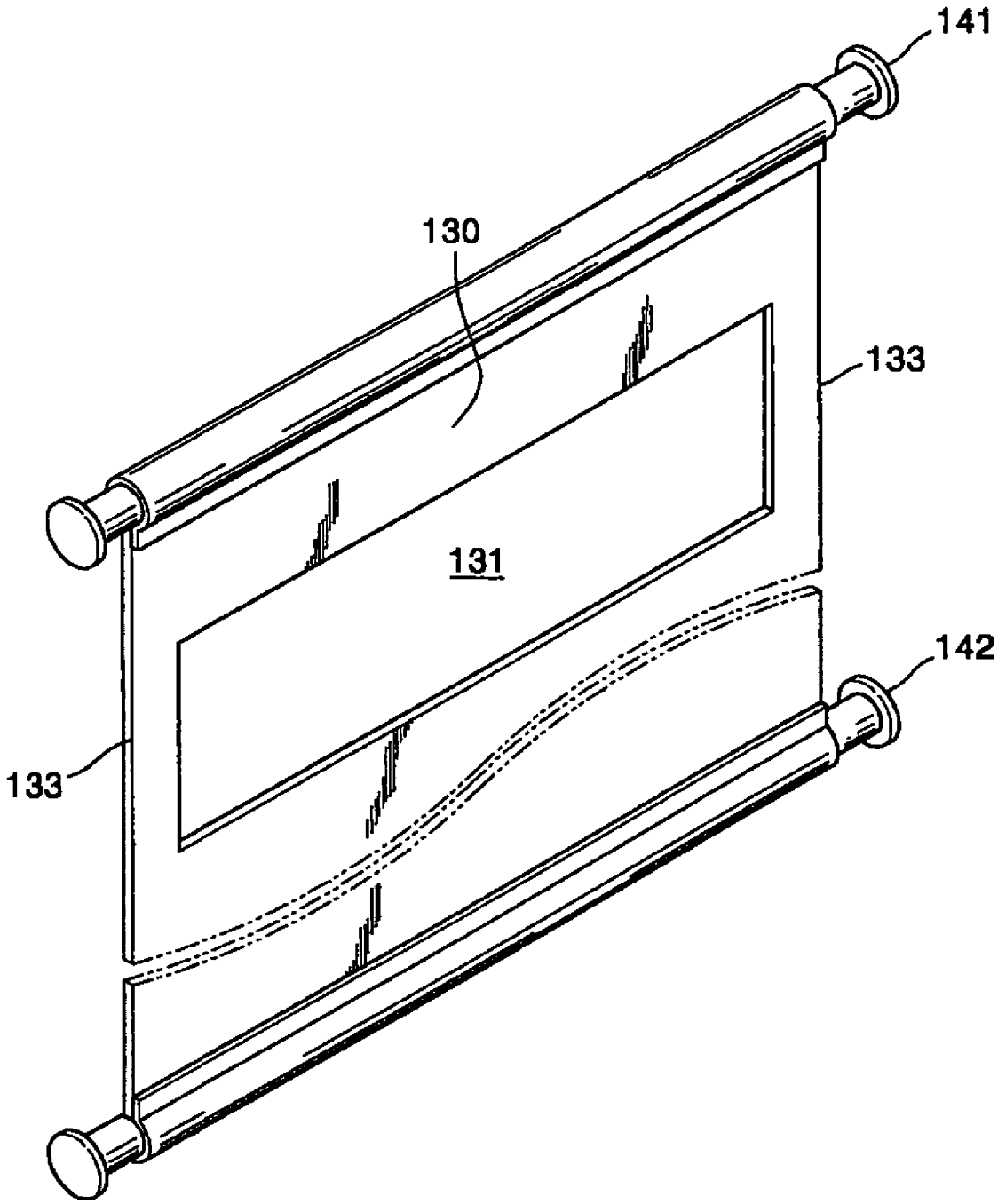
FIG. 4 is a perspective view of a protective cover.

When the developing cartridge 100 is separated from the image forming apparatus (not shown), a part 121 of the outer circumference of the photosensitive drum 120 may be exposed to external light. Therefore, a developing cartridge 100 according to an embodiment of the present invention includes a protective cover 130 movable between a first position where the light is blocked and a second position where the outer circumference 121 of the photosensitive drum 120 is exposed. A guide unit guides the protective cover 130 so as not to exceed a range occupied by the housing 101 when the protective cover 130 is moved to the first position or second position. The protective cover 130 is preferably a flexible sheet. As shown in FIG. 4, the protective cover 130 may include an open portion 131. The guide unit includes a rail 150 for forming a path for movement of the protective cover 130, and a pair of supporting members 141 and 142 that are inserted into the rail 150. Both end portions of the protective cover 130 in the moving direction of the cover 130 are coupled to the supporting members 141 and 142 that are preferably formed as bars, as shown in FIG. 4. The rail 150 is disposed on a side 102 of the housing 101. The rail 150 in the exemplary embodiment is formed as a penetrated slot, however, the present invention is not limited thereto. End portions of the supporting members 141 and 142 are inserted into the rail 150. A coil spring (elastic member) 180 is connected to the supporting member 141 to elastically bias the protective cover 130 so that the protective cover 130 is located at the first position where the cover 130 covers the outer circumference 121 of the photosensitive drum 120 to block external light.

Figure 5:
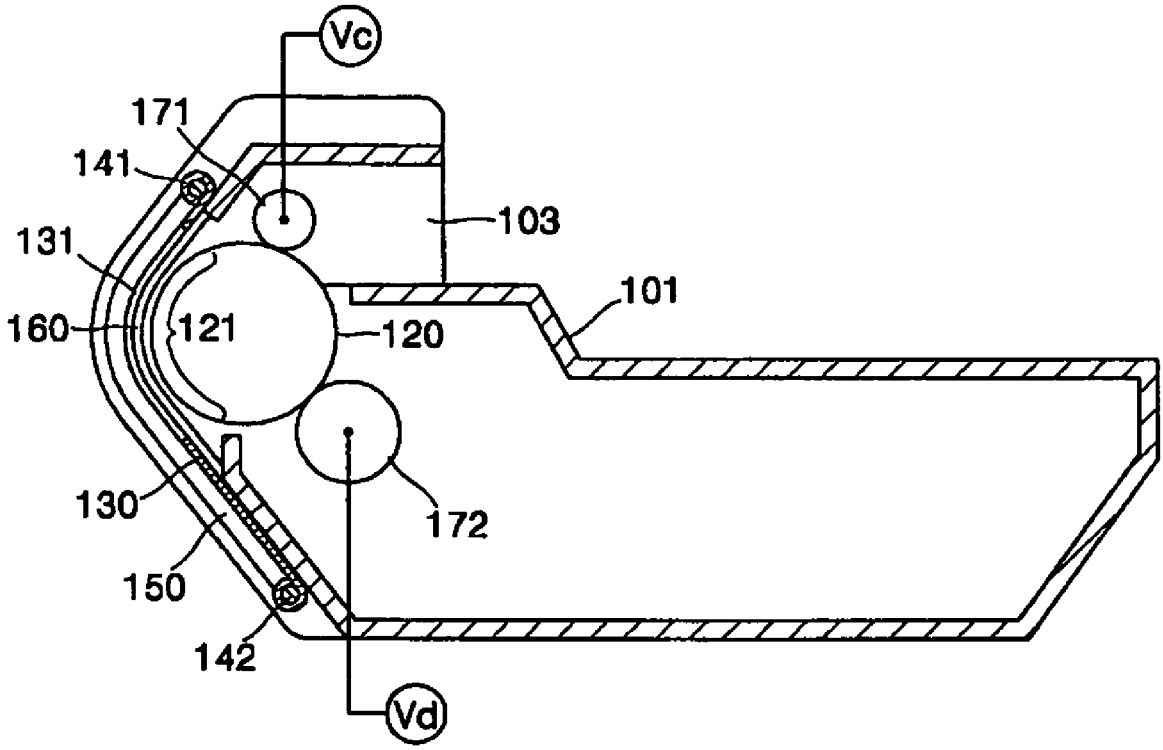
FIG. 5 is a cross-sectional view of operations of the developing cartridge of FIG. 1.

An opening and closing device for opening and closing the protective cover 130 is disposed in the image forming apparatus. FIG. 1 shows an example of the opening and closing device. Referring to FIG. 1, a rotatable lever 10 is disposed outside of the developing cartridge 100. When the developing cartridge is mounted in the image forming apparatus, the lever 10 contacts an end portion of the supporting member 142. A pair of levers 10 may be used to contact the both end portions of the supporting member 142. When the lever 10 rotates to the position denoted by a dotted line in FIG. 1 by a driving unit (not shown), the lever 10 pulls the supporting member 142 in a direction indicated by arrow A of FIG. 1 along the rail 150. The protective cover 130 is moved to the second position where the open portion 131 is located at the outer circumference 121 of the photosensitive drum 120 along the rail 150, as shown in FIG. 5. The outer circumference 121 of the photosensitive drum 120 is exposed to outside of the housing 101 through the opening portion 131. When the lever 10 returns to the position that is denoted by a solid line in FIG. 1, the protective cover 130 is moved to the first position where the outer circumference 121 of the photosensitive drum 120 is covered due to a recovery force of the coil spring 180. Then the developing cartridge 100 is separated from the image forming apparatus in above status.

Figure 6:
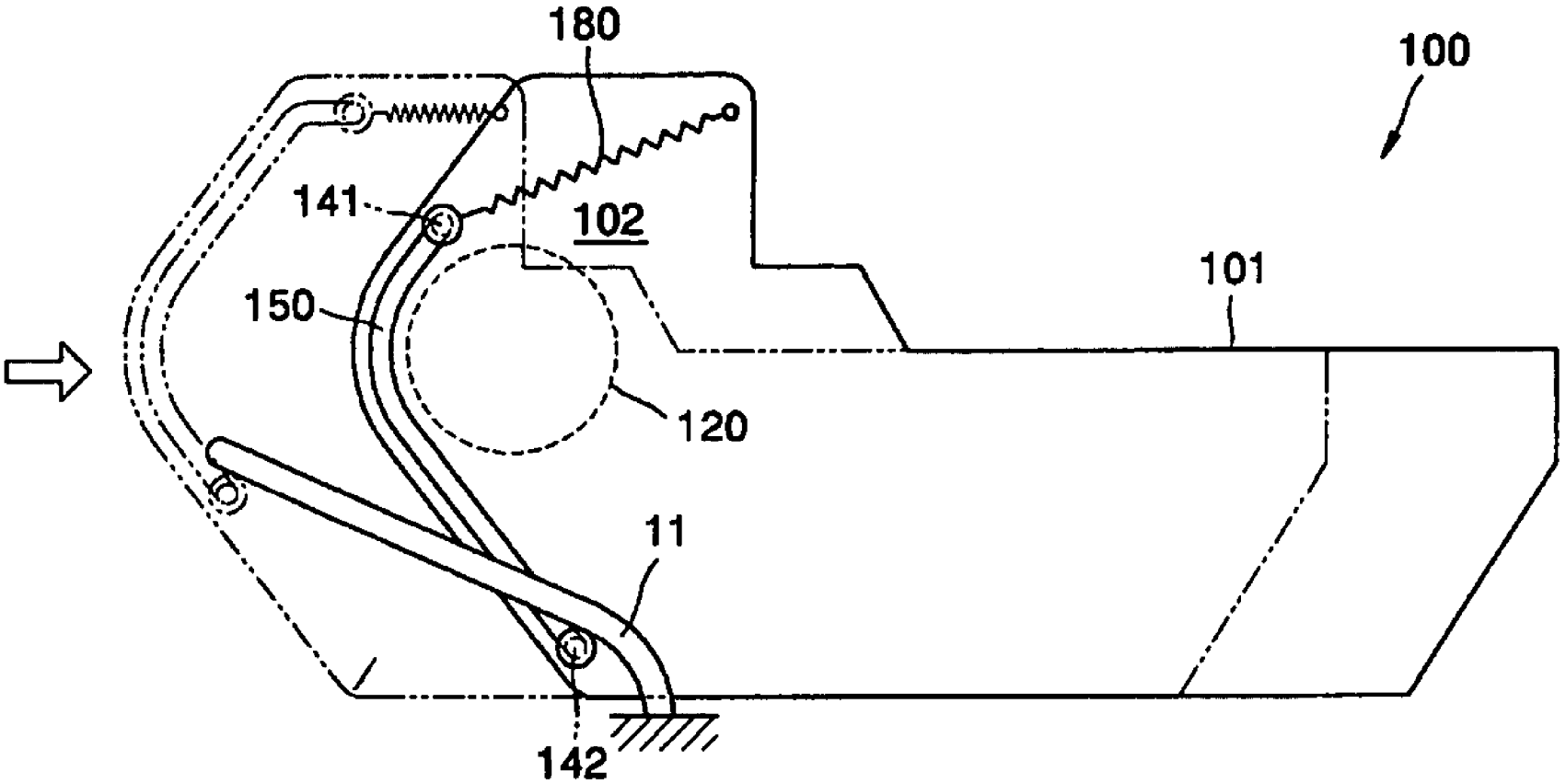
FIG. 6 is a side view of a developing cartridge according to another embodiment of the present invention.

FIG. 6 is a side view showing another example of the opening and closing device. Referring to FIG. 6, a lever 11 is fixedly installed on the image forming apparatus and slanted with respect to the apparatus. When the developing cartridge 100 is inserted into the image forming apparatus in a direction indicated by the arrow of FIG. 6, an end portion of the supporting member 142 contacts the lever 11 and moves in a direction indicated by arrow A in FIG. 1 along the rail 150. Then the protective cover 130 moves to the second position shown in FIG. 3. When the developing cartridge 100 is separated from the image forming apparatus, the protective cover 130 is moved to the first position by the recovery force of the coil spring 180.

As described above, according to the developing cartridge 100 of an exemplary embodiment, the protective cover 130 of flexible sheet is moved to the first position and the second position along the rail 150 disposed on the developing cartridge 100. Thus, the protective cover 130 does not exceed the range occupied by the developing cartridge 100, that is, occupied by the housing 101 during movement of the protective cover. Also, when the protective cover 130 is located at the second position, the protective cover 130 is located within the range occupied by the housing 101. Therefore, there is no need to provide extra space to be occupied by the protective cover 130 during movement of the protective cover 130 or when the protective cover 130 is located at the second position in the image forming apparatus, thereby reducing a size of the image forming apparatus.

The developing cartridge 100 may further include a protective cover guide 160 so that the protective cover 130 may be moved to the first and second positions without contacting the outer circumference 121 of the photosensitive drum 120. The protective cover guide 160 protrudes from the side portion 102 of the housing 101, as shown in FIGS. 2 and 3, and guides a side portion 133 of the protective cover 130. The protective cover guide 160 is disposed in a position that is radially spaced from the outer circumference 121 of the photosensitive drum 120.

Figure 7:
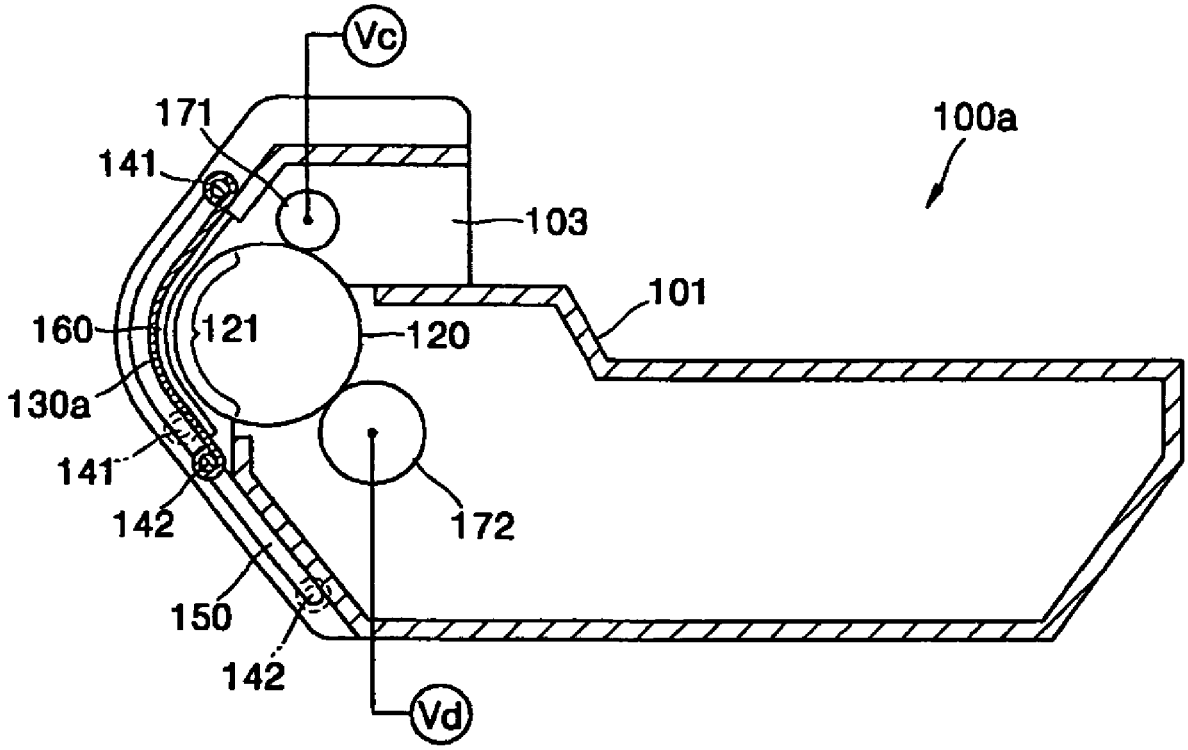
FIG. 7 is a cross-sectional view of operations of the developing cartridge shown in FIG. 6.
Figure 8:
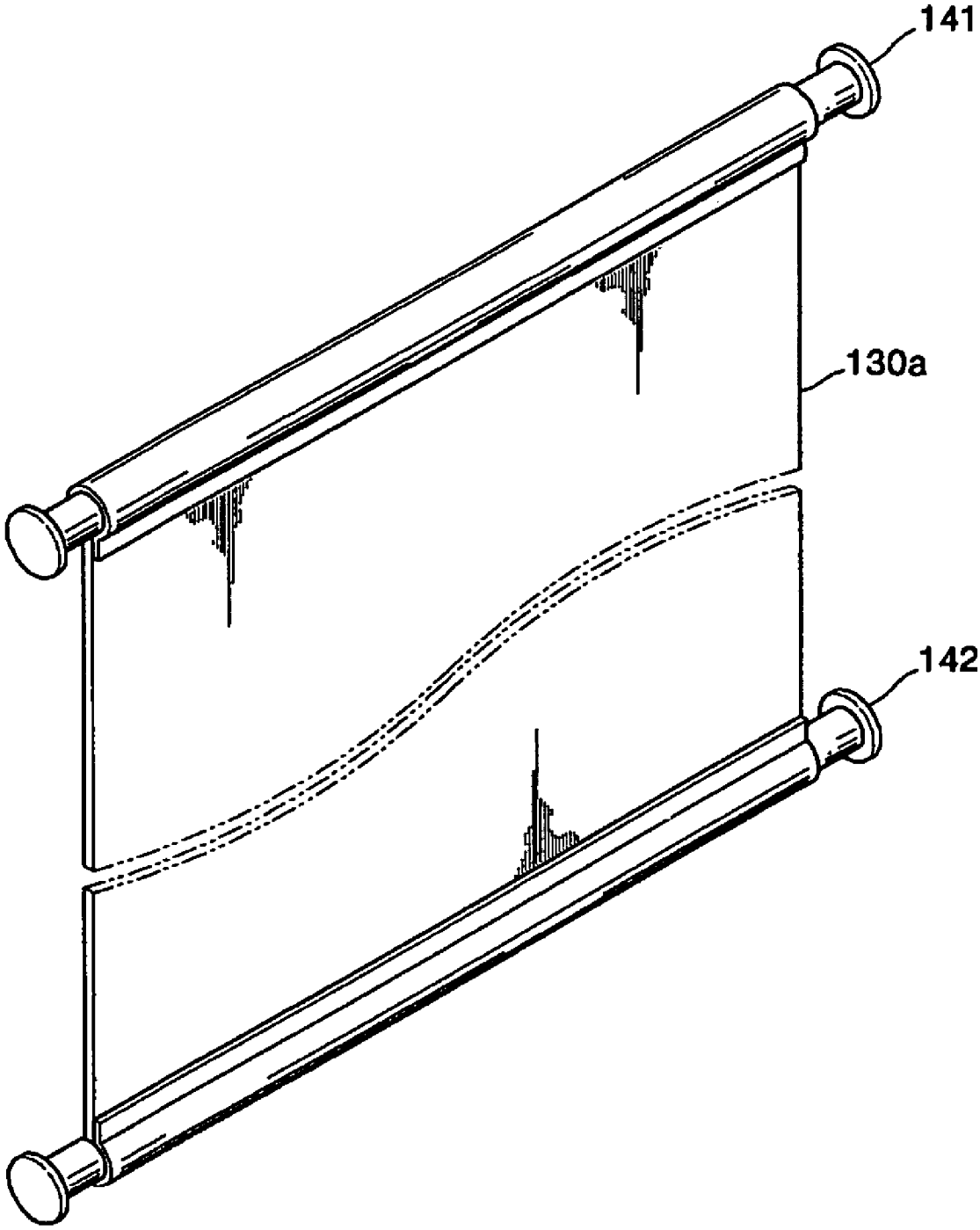
FIG. 8 is a perspective view of another example of the protective cover.

FIG. 7 is a cross-sectional view of a developing cartridge according to another exemplary embodiment of the present invention. The developing cartridge 100*a* includes a protective cover 130*a* having no opening portion 131, as shown in FIG. 8, and the other elements of the developing cartridge 100*a* are substantially similar to those of the developing cartridge 100 shown in FIGS. 1 through 6.

Figure 9:
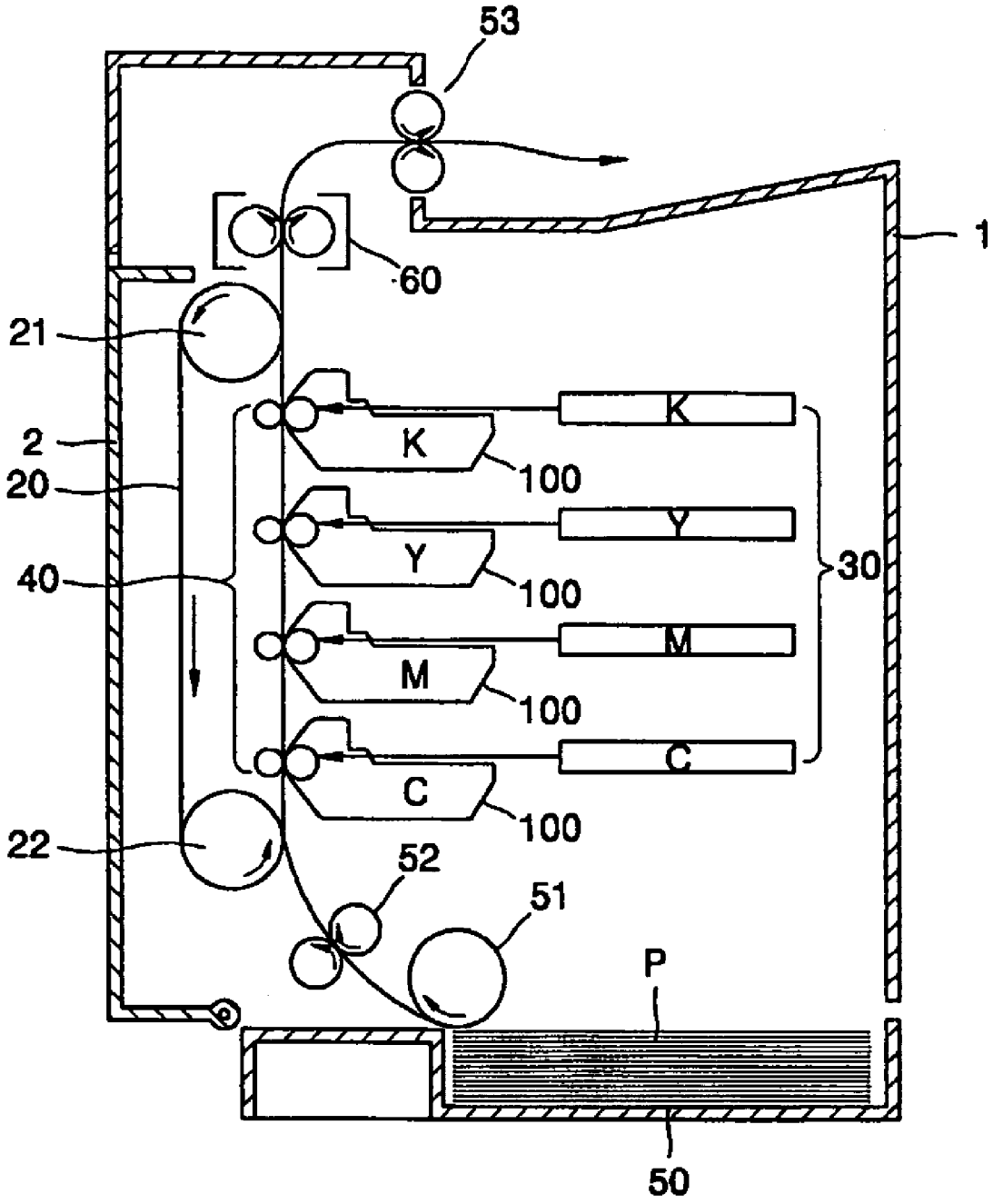
FIG. 9 is a schematic view of an image forming apparatus according to an embodiment of the present invention.

FIG. 9 is a schematic view of an electrophotographic image forming apparatus according to the present invention, and the image forming apparatus of the present invention is preferably a color-image forming apparatus.

Referring to FIG. 9, the image forming apparatus includes a carrier belt 20 that is supported and rotated by a pair of supporting rollers 21 and 22. The carrier belt 20 is preferably vertically installed in the image forming apparatus. Four developing cartridges 100C, 100M, 100Y, and 100K that respectively contain toners of cyan (C), magenta (M), yellow (Y), and black (K) colors are disposed on a side portion of the carrier belt 20. Each of the developing cartridges 100C, 100M, 100Y, and 100K has the structure shown in FIGS. 1 through 5. Alternatively, the developing cartridge 100*a* shown in FIGS. 6 through 8 may be used. The outer circumference 121 of the photosensitive drum 120, which is exposed through the housing 101, faces the carrier belt 20. The photosensitive drum 120 of each developing cartridge 100C, 100M, 100Y, or 100K is charged by the charging roller 171. Four light scanning units 30C, 30M, 30Y, and 30K form the electrostatic latent images by scanning the lights corresponding to the color information of cyan, magenta, yellow, and black colors onto the developing cartridges 100C, 100M, 100Y, and 100K through the opening 103. The developing roller 172 supplies the toner onto the electrostatic latent image to form the toner image of cyan, magenta, yellow, or black color on the photosensitive drum 120 of the each developing cartridge 100C, 100M, 100Y, or 100K.

The paper drawn from a cassette 50 by the pickup roller 51 is induced into the carrier belt 20 by a conveying roller 52. The paper is attached on the surface of the carrier belt 20 by an electrostatic force. Four transfer rollers 40 are disposed to face the photosensitive drums 120 of the developing cartridges 100C, 100M, 100Y, and 100K while interposing the carrier belt 20 therebetween. Transfer biases are applied to the transfer rollers 40 for transferring the toner images attached on the photosensitive drums 120 onto the paper, although these are not shown in the drawing. Accordingly, the toner images of the four colors are transferred sequentially onto the paper, and fused on the paper by heat and pressure when the paper passes the fusing device 60. The paper, on which the image printing operation is completed, is discharged out of the image forming apparatus by a discharging roller 53.

The image forming apparatus includes a door 2 on a main body 1 thereof to install or separate the developing cartridge 100 in and from the apparatus. In the present embodiment, the door 2 is rotatably installed on a side portion of the main body 1, and the carrier belt 20, the fusing device 60, and the transfer rollers 40 are also rotated together when the door 2 is opened. Therefore, a user may install or separate the developing cartridge 100 in and from the main body 1 after opening the door 2. In the image forming apparatus according to an exemplary embodiment of the present embodiment, the protective cover 130 of the developing cartridge 100 is moved to the first position and the second position while being connected to the opening and closing operations of the door 2. That is, when the door 2 is closed, the protective cover 130 moves to the second position for exposing the outer circumference 121 of the photosensitive drum 120, and when the door 2 is opened, the protective cover 130 moves to the first position for covering the outer circumference 121 of the photosensitive drum 120.

Figure 10:
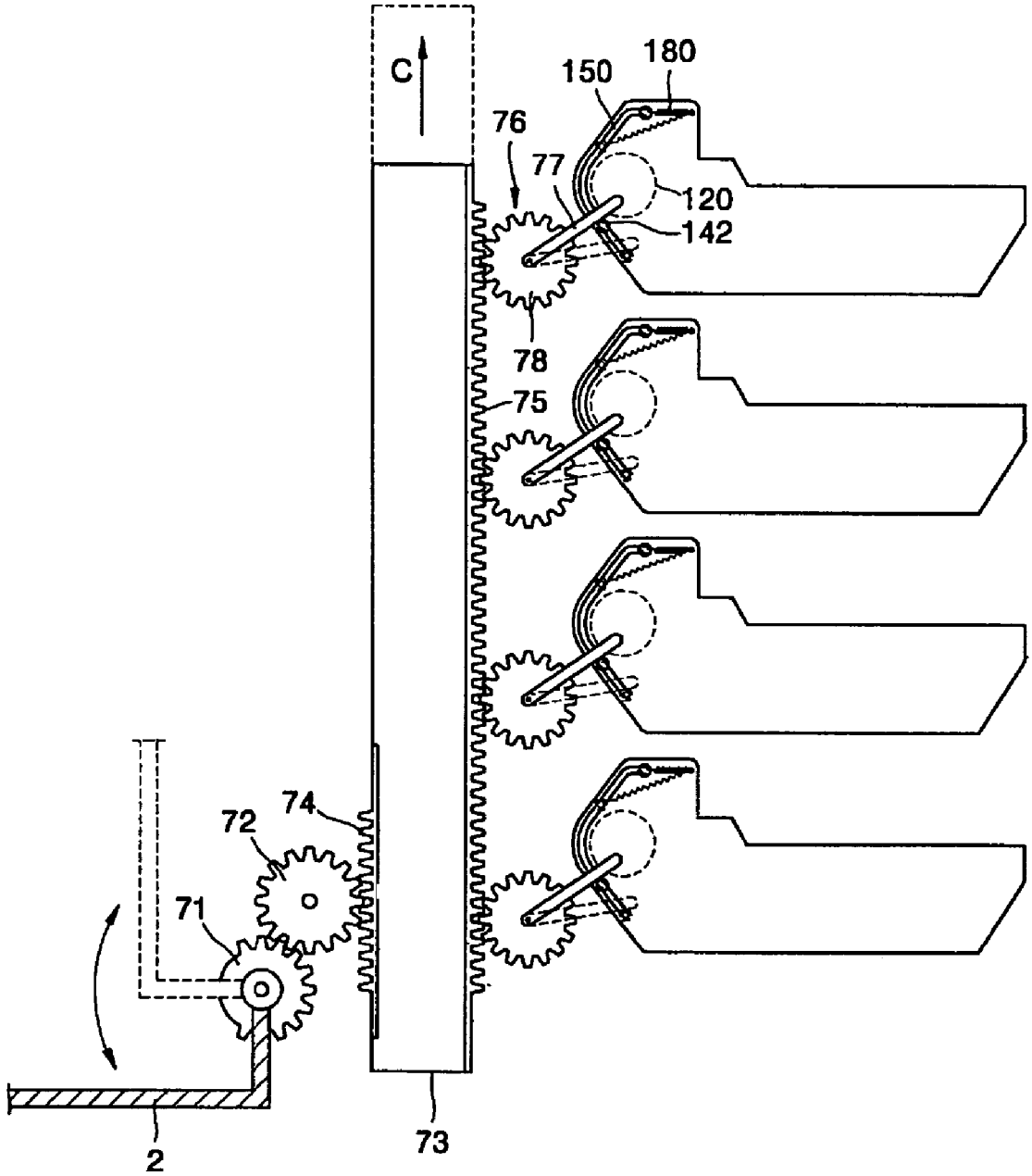
FIG. 10 is a schematic view of an opening and closing device in the image forming apparatus of the present invention.

Thus, the image forming apparatus includes an opening and closing device for moving the protective cover 130. FIG. 10 is a schematic view of an example of the opening and closing device. Referring to FIG. 10, the opening and closing device includes a first gear 71, a second gear 72, a sliding member 73, and a rotating member 76. The first gear 71 is formed coaxially with the door 2, and rotates with the door 2 when the door 2 is opened and closed. The sliding member 73 is installed to be moved in a vertical direction, and includes a first rack gear 74 and a second rack gear 75 on both sides thereof. The rotating member 76 includes a lever 77 that contacts the supporting member 142 and a gear 78. The first gear 71 is connected to the first rack gear 74 via the second gear 72. The gear 78 is connected to the second rack gear 75.

To install the developing cartridge 100 in the main body 1 of the image forming apparatus, the door 2 is rotated to a position that is denoted by a solid line in FIG. 10 to open a side portion of the main body 1. When the developing cartridge 100 is installed in the main body 1, the lever 77 contacts the supporting member 142 as denoted by the solid line of FIG. 10. Here, the protective cover 130 is located at the first position where the outer circumference 121 of the photosensitive drum 120 is covered by the elastic force of the coil spring 180 as shown in FIG. 3. When the door 2 is closed, the rotary force of the first gear 71 is transmitted to the first rack gear 74 via the second gear 72. The sliding member 73 is slid in a direction indicated by arrow C, which rotates the lever 77 to a position denoted by a dotted line in FIG. 10. The lever 77 pushes the supporting member 142 to move the supporting member 142 in the direction indicated by arrow A in FIG. 1 along the rail 150. Then, as shown in FIG. 5, the protective cover 130 is moved to the second position, and the outer circumference 121 of the photosensitive drum 120 is exposed through the opening portion 131 and faces the carrier belt 20. When the door 2 is opened, the protective cover 130 moves to the first position through the process substantially opposite to the above described process.

The image forming apparatus according to exemplary embodiments is the color image forming apparatus including four developing cartridges, however, the present invention is not limited thereto. The developing cartridge and the opening and closing device shown in FIG. 10 may be applied to an image forming apparatus for printing a mono-color image. In that case, the opening and closing device may have the second gear 72 and the gear 77 of the lever 76 that are directly connected to each other. The opening and closing device may be modified variously according to the position of the door or mounting structure of the developing cartridge in the image forming apparatus, besides the example shown in FIG. 10.

According to the developing cartridge and the image forming apparatus including the developing cartridge of the present invention, there is no need to ensure availability of space to be occupied by the protective cover 130 when the protective cover 130 is moving or is located at the second position in the image forming apparatus, thereby reducing the size of the image forming apparatus.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A developing cartridge, comprising:

a housing having a photosensitive medium;

a protective cover movable between a first position in which the protective cover covers the photosensitive medium and a second position in which a part of the photosensitive medium is exposed, the protective cover having an opening through which the photosensitive medium is exposed when the protective cover is in the second position; and a guide unit to guide the protective cover to prevent movement beyond the housing when the protective cover is moved between the first and second positions.

2. The developing cartridge of claim 1, wherein the protective cover is a flexible sheet.

3. The developing cartridge of claim 1, wherein a pair of supporting members support opposite end portions of the protective cover in a moving direction of the cover; and a rail disposed on a side portion of the housing to form a moving path of the protective cover, the rail being adapted to receive the pair of supporting members.

4. The developing cartridge of claim 3, wherein a protective cover guide is disposed in the housing and radially spaced from the outer circumference of the photosensitive medium to prevent the protective cover from contacting the photosensitive medium.

5. The developing cartridge of claim 3, wherein an elastic member elastically biases the protective cover to move toward the first position.

6. An image forming apparatus, comprising:

a main body;

a developing cartridge disposed in the main body, the developing cartridge including a housing having a photosensitive medium, a protective cover movable between a first position where the protective cover covers the photosensitive medium and a second position where a part of the photosensitive medium is exposed, an opening in the protective cover through which the photosensitive medium is exposed when the protective cover is in the second position, and a guide unit to guide the protective cover to prevent movement beyond the housing when the protective cover is moved between the first and second positions;

a door to open a part of the main body to install and remove the developing cartridge; and an opening and closing device to move the protective cover toward the first position when the door is opened, and the second position when the door is closed.

7. The apparatus of claim 6, wherein the protective cover is a flexible sheet.

8. The apparatus of claim 6, wherein a pair of supporting members support opposing end portions of the protective cover in a moving direction of the cover; and a rail disposed on a side portion of the housing to form a moving path of the protective cover, the rail being adapted to receive the pair of supporting members.

9. The apparatus of claim 8, wherein a protective cover guide is disposed in the housing and radially spaced from the outer circumference of the photosensitive medium to prevent the protective cover from contacting the photosensitive medium.

10. The apparatus of claim 6, wherein an elastic member elastically biases the protective cover to move toward the first position.

11. The apparatus of claim 6, wherein the opening and closing device has a first gear connected to the door that rotates a second gear, the second gear engaging a sliding member that moves vertically in response to opening and closing of the door.

12. The apparatus of claim 11, wherein a third gear connected to one of the pair of supporting members engages the sliding member, thereby moving the protective cover between the first and second positions in response to opening and closing of the door.

13. The apparatus of claim 12, wherein a first gear rack is disposed on a first side of the sliding member to engage the second gear and a second gear rack is disposed on a second side of the sliding member to engage the third gear.

14. The apparatus of claim 12, wherein a plurality of developing cartridges are disposed in the main body, and a plurality of third gears are connected to one of the pair of supporting members of each of the developing cartridges.

15. The apparatus of claim 14, wherein each of the plurality of third gears engages the sliding member to move each of the protective covers between the first and second positions in response to opening and closing of the door.

* * * * *